US010735864B2

(12) United States Patent
Gong et al.

(10) Patent No.: US 10,735,864 B2
(45) Date of Patent: Aug. 4, 2020

(54) SPEAKER

(71) Applicant: SHENZHEN GRANDSUN ELECTRONIC CO., LTD., Shenzhen, Guangdong (CN)

(72) Inventors: Weiyong Gong, Shenzhen (CN); Haiquan Wu, Shenzhen (CN); Mickael Bernard Andre Lefebvre, Shenzhen (CN); Ruiwen Shi, Shenzhen (CN)

(73) Assignee: SHENZHEN GRANDSUN ELECTRONIC CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 16/247,360

(22) Filed: Jan. 14, 2019

(65) Prior Publication Data

US 2019/0335278 A1 Oct. 31, 2019

(30) Foreign Application Priority Data

Apr. 28, 2018 (CN) ..... 2018 2 0638542 U

(51) Int. Cl.

| | |
|---|---|
| ***H04R 9/06*** | (2006.01) |
| ***H04R 7/12*** | (2006.01) |
| ***H04R 7/18*** | (2006.01) |
| ***H04R 9/02*** | (2006.01) |

(52) U.S. Cl.

CPC ..... *H04R 9/06* (2013.01); *H04R 7/12* (2013.01); *H04R 7/18* (2013.01); *H04R 9/025* (2013.01); *H04R 2307/027* (2013.01); *H04R 2307/204* (2013.01)

(58) Field of Classification Search

CPC ..... H04R 2307/027; H04R 2307/204; H04R 31/003; H04R 9/06; H04R 7/12; H04R 7/18

See application file for complete search history.

(56) References Cited

U.S. PATENT DOCUMENTS

| | | | | |
|---|---|---|---|---|
| 2007/0140519 | A1* | 6/2007 | Fukuyama | H04R 31/006 381/398 |
| 2008/0053745 | A1* | 3/2008 | Tada | H04R 1/24 181/165 |
| 2017/0180865 | A1* | 6/2017 | Fujitani | H04R 31/003 |

* cited by examiner

*Primary Examiner* — Sunita Joshi

(74) *Attorney, Agent, or Firm* — Conley Rose, P.C.; Grant Randolph

(57) ABSTRACT

A speaker, including: a magnetic circuit system, a vibration system, and a speaker support, the speaker support is provided with a mounting cavity, both the magnetic circuit system and the vibration system are mounted in the mounting cavity; the vibration system includes a metal diaphragm and a flexible connector; the metal diaphragm is placed in the mounting cavity; an inner periphery of the flexible connector is bonded to an outer periphery of the metal diaphragm, and an outer periphery of the flexible connector is bonded to an inner periphery of the speaker support. The overall rigidity of the vibration system of the speaker can be improved via adopting the metal diaphragm, and the overall performance of the speaker is improved.

20 Claims, 5 Drawing Sheets

SPEAKER

CROSS REFERENCE TO RELATED APPLICATION

The present application claims priority to Chinese Patent Application No. 201820638542.5, filed on Apr. 28, 2018, entitled "speaker", the entire disclosure of which is incorporated herein by reference.

TECHNICAL FIELD

The present application relates to the technical field of an electronic product, and more particularly to a speaker.

BACKGROUND

A speaker is a very typical electro-acoustic transducer, which can be used to convert electrical signals into acoustic signals, and is widely used in mobile phones, computers, televisions, and the like electronic devices and electronic components with audio playback capabilities. The speaker has become an indispensable part of people's daily lives.

With the continuous updating of audio playback devices, people's requirements for tone quality are becoming stricter, a vibration system of the speaker is one of the main components for speaker vibration and sound production, which is also the key design to control the sound effect of the speaker. The traditional vibration system often has problems due to the structure and material of the diaphragm itself and the connection between the diaphragm and the speaker support and the like, which leads to the rigidity of the vibration system not being enough, or the rigidity cannot be used well; thereby, split vibration is easy to occur when the speaker is vibrated at high-frequency, and the sound effect of the speaker is affected.

SUMMARY

An object of the present application is to provide a speaker to solve the technical problem that the split vibration is easy to occur in the speaker due to the rigidity of the vibration system not being enough in the prior art.

In order to achieve the above object, the technical solution is adopted by the present application that a speaker, including: a magnetic circuit system, a vibration system, and a speaker support, the speaker support is provided with a mounting cavity, the magnetic circuit system and the vibration system are mounted in the mounting cavity; the vibration system includes a metal diaphragm and a flexible connector; the metal diaphragm is placed in the mounting cavity; an inner periphery of the flexible connector is bonded to an outer periphery of the metal diaphragm, and an outer periphery of the flexible connector is bonded to an inner periphery of the speaker support.

Further, the flexible connector is made of a non-metallic material.

Further, the flexible connector is made of at least one material selected from the group consisting of a PET (Polyethylene terephthalate), a PEN (Polyethylene naphthalate two formic acid glycol ester), a PEEK (polyetheretherketone), a PU (polyurethane), a PAR (Polyarylate), a PEI (Polyetherimide), a silica gel, a silk, and a cloth.

Further, a middle portion of the flexible connector is arched in a direction away from the speaker support to form an arcuate structure, the arcuate structure is provided with a hanging edge at each periphery thereof.

Further, the metal diaphragm includes a hemispherical diaphragm portion that is provided with a central convex, a periphery of the hemispherical diaphragm portion is extended in a horizontal direction and configured to form an annular flat diaphragm portion, a periphery of the annular flat diaphragm portion is folded toward the convex direction of the hemispherical diaphragm portion and configured to extend away from the hemispherical diaphragm portion to form a trumpet-shaped diaphragm portion; an outer periphery of the trumpet-shaped diaphragm portion is in sealing connection with an inner circumference of the flexible connector.

Further, a height of an outer periphery of the trumpet-shaped diaphragm portion is greater than a height of a central portion of the hemispherical diaphragm portion.

Further, the metal diaphragm is made of at least one material selected from the group consisting of magnesium, aluminum, beryllium, and titanium.

Further, a thickness of the metal diaphragm ranges from 6 to 50 micrometers (μm), or 60 to 300 μm.

Further, the speaker support includes a frame and a U-shaped cup, and the frame and the U-shaped cup are in fastening connection with each other to form a mounting cavity, the metal diaphragm covers at the frame, an outer periphery of the flexible connector is connected with an inner periphery of the frame.

Further, the magnetic circuit system includes a first magnetic assembly, a magnet assembly, and a second magnetic assembly sequentially stacked in the U-shaped cup, and the centers of the U-shaped cup, the first magnetic assembly, the magnet assembly, and the second magnetic assembly are located on the same line; the first magnetic assembly includes a first internal magnetic member and a first external magnetic member disposed around an outer periphery of the first internal magnetic member, and the first external magnetic member is spaced apart from the first internal magnetic member to form a first magnetic gap; the magnet assembly includes a central magnet and a peripheral magnet disposed around an outer periphery of the central magnet, and the peripheral magnet is spaced apart from the central magnet to form a second magnetic gap; the second magnetic assembly includes a second internal magnetic member and a second external magnetic member disposed around an outer periphery of the second internal magnetic member, and the second external magnetic member is spaced apart from the second internal magnetic member to form a third magnetic gap; the first magnetic gap, second magnetic gap, and the third magnetic gap are in communication with each other.

Further, the vibration system further includes a voice coil, a first end of the voice coil is fixedly connected to the metal diaphragm, and a second end of the voice coil is configured to sequentially pass through the third magnetic gap and the second magnetic gap and is suspended in the first magnetic gap.

Further, the speaker further includes a circuit board, the circuit board is fixedly connected to the frame, and the circuit board is electrically connected to the voice coil.

Further, the speaker further includes a damping enhancement system, and the damping enhancement system includes a first damping member configured to sealingly cover an outer bottom of the frame and a second damping member configured to sealingly cover an outer bottom of the U-shaped cup.

The present application has the beneficial effects that the speaker of the present application has a diaphragm of metal diaphragm, since the rigidity of the metal diaphragm is much greater than the strength of other materials such as a paper diaphragm, thereby the overall rigidity of the vibration system of the speaker can be improved via adopting the metal diaphragm, and the split vibration of the speaker during high-frequency vibration can be reduced to make the high-frequency curve of the speaker smoother. In addition, the flexible connector of the speaker support is designed to connect with the metal diaphragm to make the metal diaphragm more easy to vibrate and for easier sound production, and the damping characteristics of the vibration system can also be effectively increased to further reduce the split distortion of the speaker at high-frequency, the bandwidth of the speaker is extended, and the overall performance of the speaker is improved.

BRIEF DESCRIPTION OF THE DRAWINGS

In order to explain the embodiments of the present application more clearly, a brief introduction regarding the accompanying drawings that need to be used for describing the embodiments of the present application or the prior art is given below; it is obvious that the accompanying drawings described as follows are only some embodiments of the present application, for those skilled in the art, other drawings can also be obtained according to the current drawings on the premise of paying no creative labor.

Figure 1:
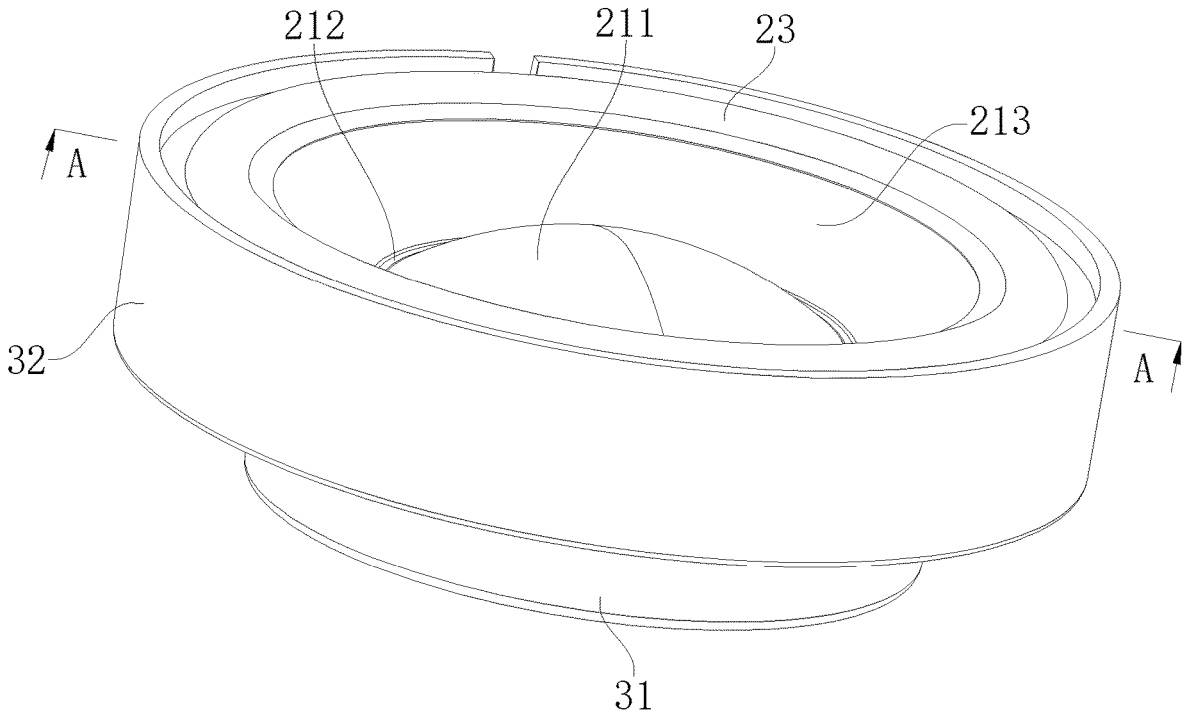
FIG. 1 is a schematic structural view of a speaker provided in an embodiment of the present application.

The reference numerals are listed as follows: 10—magnetic circuit system, 11—first magnetic assembly, 12—magnet assembly, 13—second magnetic assembly, 20—vibration system, 21—metal diaphragm, 22—voice coil, 23—flexible connector, 30—speaker support, 31—U-shaped cup, 32—frame, 40—damping enhancement system, 41—first damping member, 42—second damping member, 50—circuit board, 111—first internal magnetic member, 112—first external magnetic member, 113—first magnetic gap, 121—central magnet, 122—peripheral magnet, 123—second magnetic gap, 131—second internal magnetic member, 132—second external magnetic member, 133—third magnetic gap, 211—hemispherical diaphragm portion, 212—annular flat diaphragm portion, 213—trumpet-shaped diaphragm portion, 311—positioning cylinder, 312—receiving groove, 1211—central magnet unit, and 1221—peripheral magnet unit.

DETAILED DESCRIPTION OF THE EMBODIMENTS

The embodiments of the present application are described in detail, and examples of the embodiment are illustrated in the accompanying figures; wherein, an always-unchanged reference number or similar reference numbers represent(s) identical or similar components or components having identical or similar functionalities. The embodiment described below with reference to the accompanying FIGS. 1-5 are illustrative and intended to illustrate the present application, but should not be considered as any limitation to the present application.

In the description of the present application, it needs to be understood that, directions or location relationships indicated by terms such as "length", "width", "up", "down", "front", "rear", "left", "right", "vertical", "horizontal", "top", "bottom", "inside", "outside", and so on are the directions or location relationships shown in the accompanying figures, which are only intended to describe the present application conveniently and simplify the description, but not to indicate or imply that an indicated device or component must have specific locations or be constructed and manipulated according to specific locations; therefore, these terms shouldn't be considered as any limitation to the present application.

In addition, terms "the first" and "the second" are only used in descriptive purposes, and should not be considered as indicating or implying any relative importance, or impliedly indicating the number of indicated technical features. As such, technical feature(s) restricted by "the first" or "the second" can explicitly or impliedly comprise one or more such technical feature(s). In the description of the present application, "a plurality of" means two or more, unless there is additional explicit and specific limitation.

In the present application, unless there is additional explicit stipulation and limitation, terms such as "mount", "connect with each other", "connect", "fix", and so on should be generally interpreted, for example, as follows: "connect" can be interpreted as being fixedly connected, detachably connected, or connected integrally; "connect" can also be interpreted as being mechanically connected or electrically connected; "connect" can be further interpreted as being directly connected or indirectly connected through intermediary, or being internal communication between two components or an interaction relationship between the two components. For the one of ordinary skill in the art, the specific meanings of the aforementioned terms in the present application can be interpreted according to specific conditions.

As shown in FIGS. 1-5, the present application is provided a speaker, including: a magnetic circuit system 10, a vibration system 20, and a speaker support 30, the speaker support 30 is provided with a mounting cavity, the magnetic circuit system 10 and the vibration system 20 are mounted in the mounting cavity; the vibration system 20 includes a metal diaphragm 21 and a flexible connector 23; the metal diaphragm 21 is placed in the mounting cavity; an inner periphery of the flexible connector 23 is bonded to an outer periphery of the metal diaphragm 21, and an outer periphery of the flexible connector 23 is bonded to an inner periphery of the speaker support 30.

The speaker in the embodiment of the present application has a diaphragm of metal diaphragm 21, since the rigidity of the metal diaphragm 21 is much greater than the strength of other materials such as a paper diaphragm, thereby the overall rigidity of the vibration system 20 of the speaker can be improved via adopting the metal diaphragm 21, and the split vibration of the speaker during high-frequency vibration can be reduced to make the high-frequency curve of the speaker smoother. In addition, the flexible connector 23 of the speaker support 30 is designed to connect with the metal diaphragm 21 to make the metal diaphragm 21 more easy to vibrate and for easier sound production, and the damping characteristics of the vibration system 20 can also be effectively increased to further reduce the split distortion of the speaker at high-frequency, the bandwidth of the speaker is extended, and the overall performance of the speaker is improved.

Specifically, the flexible connector 23 is preferably made of a non-metallic material.

More specifically, the flexible connector 23 is preferably made of at least one material selected from the group consisting of, a PET (Polyethylene terephthalate), a PEN (Polyethylene naphthalate two formic acid glycol ester), a PEEK (polyetheretherketone), a PU (polyurethane), a PAR (Polyarylate), a PEI (Polyetherimide), a silica gel, a silk, and a cloth. That is, the flexible connector 23 is preferably made of a monomer such as PU, PEEK, PET, PEN, PAR, PEI, silica gel, silk, cloth or the like, or a composite material thereof. The above materials have characteristics that the physical property is good, the flexibility is good, and the resistance for bending is good, the strength of extension is high, and the texture is light, which is used to manufacture the flexible connector. Not only is the metal diaphragm 21 fixedly connected to the speaker support 30, but also the rigidity and damping characteristic of the vibration system 20 can be better ensured due to the excellent physical property therewith, and the performance of the speaker in the embodiment can be further steadied.

Figure 2:
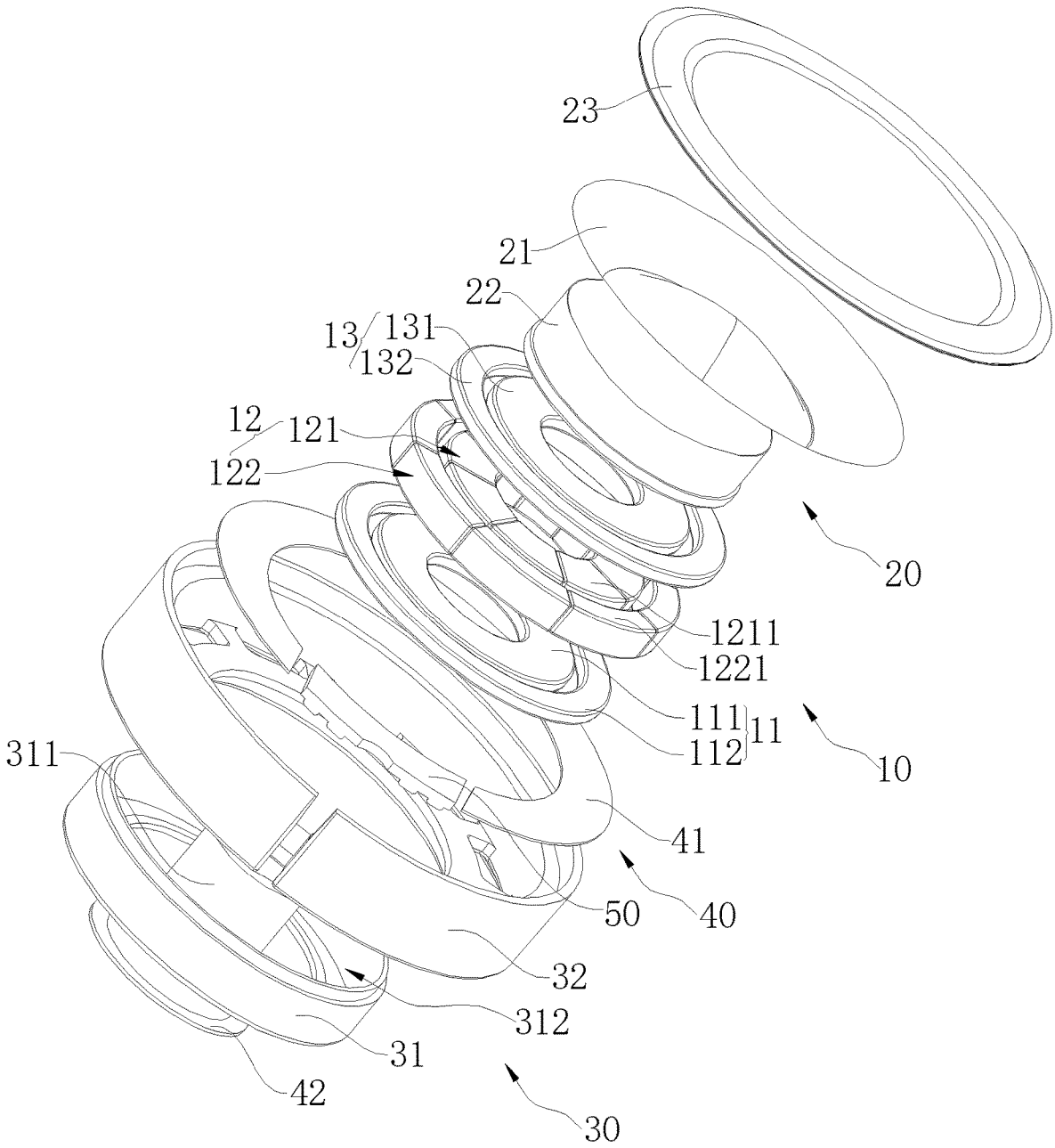
FIG. 2 is an exploded view of a speaker provided in an embodiment of the present application.
Figure 3:
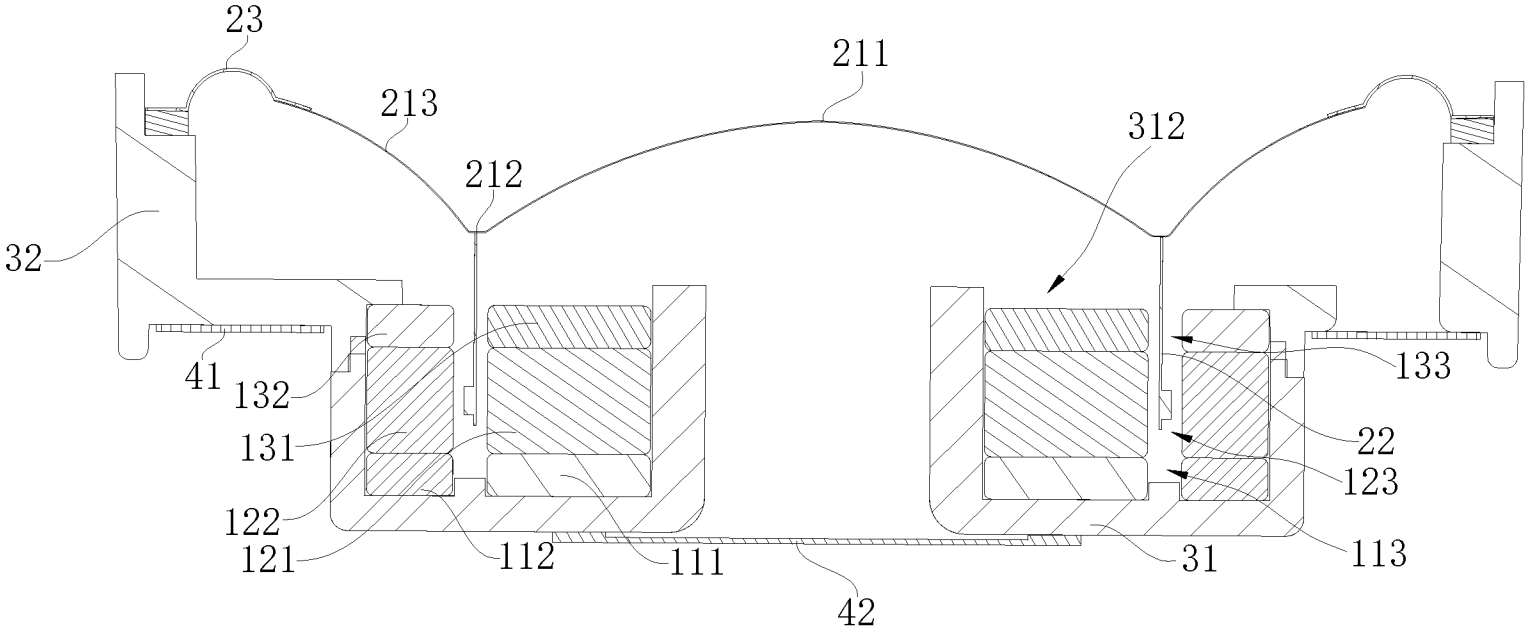
FIG. 3 is a cross-sectional view taken along line A-A of FIG. 1.

In the embodiment, as shown in FIGS. 2 and 3, a middle portion of the flexible connector 23 is arched in a direction away from the speaker support 30 to form an arcuate structure, the arcuate structure is provided with a hanging edge at each periphery thereof; the hanging edge of the arcuate flexible connector 23, configured to face the metal diaphragm 21, is fixedly connected to an outer periphery of the metal diaphragm 21, and the hanging edge of the arcuate flexible connector 23, configured to away from the metal diaphragm 21, is fixedly connected to an inner periphery of the metal diaphragm 21. The middle portion of the flexible connector 23 is arched upward to increase the effective vibration area of the flexible connector 23; the overall rigidity of the vibration system 20 is improved, and overall damping characteristics of the vibration system 20 are also improved, and the split distortion of the speaker at high-frequency can be further improved to improve the functionality of the speaker.

Figure 4:
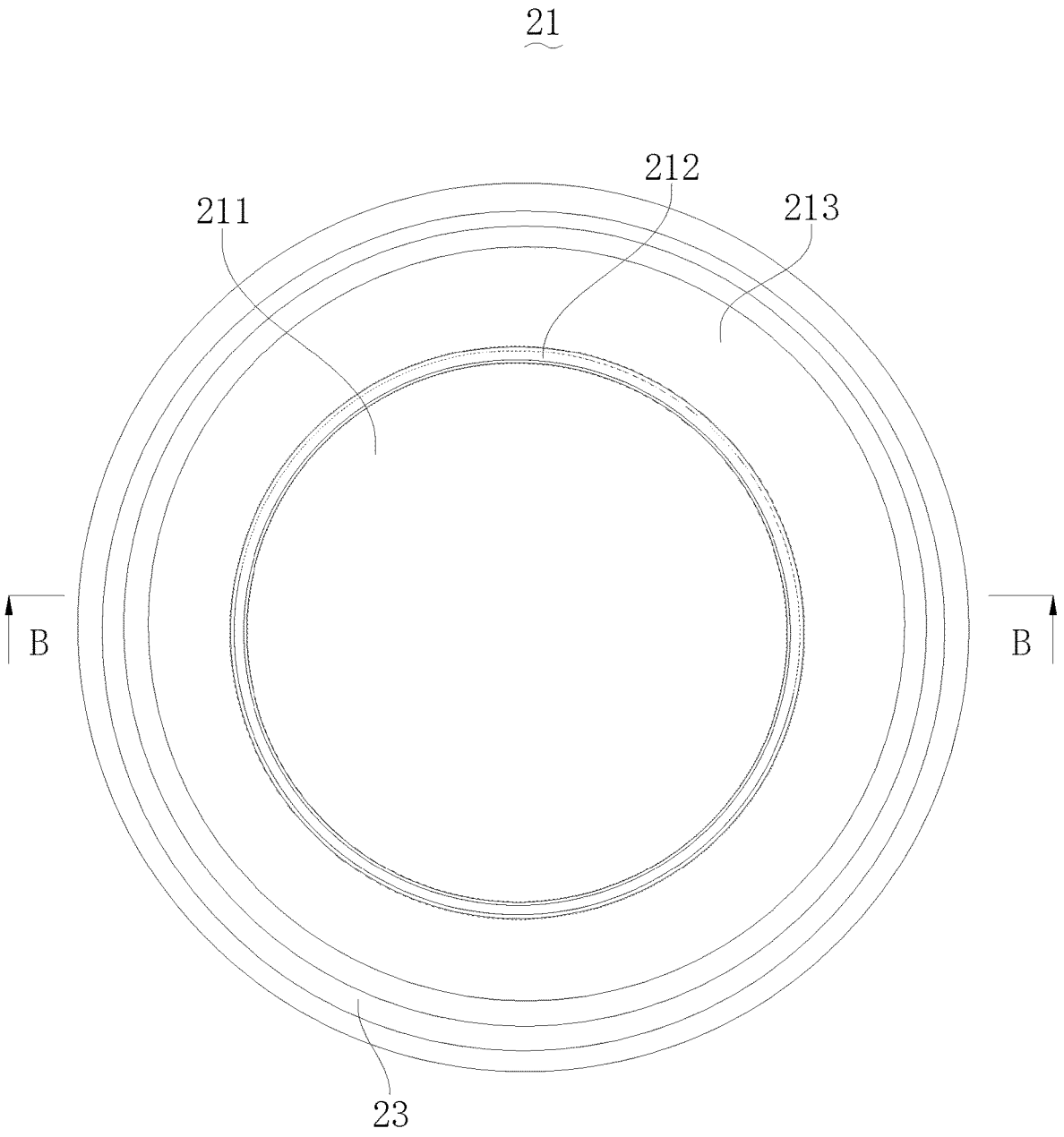
FIG. 4 is a schematic view showing the assembly of a metal diaphragm and a flexible connector of a speaker according to an embodiment of the present application.
Figure 5:
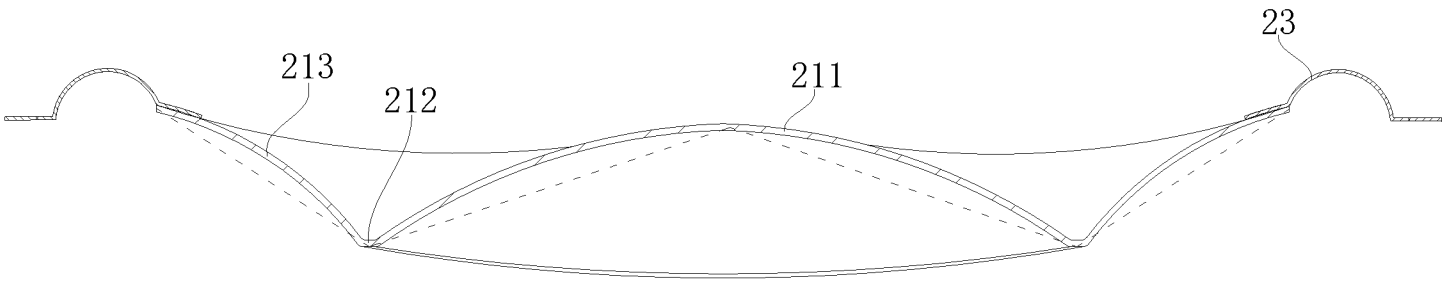
FIG. 5 is a cross-sectional view taken along line B-B of FIG. 4.

In the embodiment, as shown in FIGS. 3 to 5, the metal diaphragm 21 includes a hemispherical diaphragm portion 211 that is provided with a central convex, a periphery of the hemispherical diaphragm portion 211 is extended in a horizontal direction and configured to form an annular flat diaphragm portion 212, a periphery of the annular flat diaphragm portion 212 is folded toward the convex direction of the hemispherical diaphragm portion 211 and is configured to extend away from the hemispherical diaphragm portion 211 to form a trumpet-shaped diaphragm portion 213; an outer periphery of the trumpet-shaped diaphragm portion 213 is in sealing connection with an inner circumference of the flexible connector 23.

Specifically, since the hemispherical diaphragm portion 211 of the metal diaphragm 21 is a hemispherical structure that is provided with a convex outward at the central portion thereof, when the metal diaphragm 21 is vibrated, the hemispherical diaphragm portion 211 may be vibrated to generate a first force configured to act on the angular flat diaphragm portion away from the hemispherical diaphragm portion 211. Simultaneously, since the trumpet-shaped diaphragm portion 213 is convexly disposed toward the hemispherical diaphragm portion 211, when the metal diaphragm 21 is vibrated, the trumpet-shaped diaphragm portion 213 may generate a second force configured to act on the angular flat diaphragm portion away from the hemispherical diaphragm portion 211; the first force and the second force are simultaneously configured to be applied to the annular flat diaphragm portion 212, or the first force is transmitted to the trumpet-shaped diaphragm portion 213 through the annular flat diaphragm portion 212, and the second force is transmitted to the hemispherical diaphragm portion 211 through the annular flat diaphragm portion 212, and the first force and the second force are in opposite directions. When the first force and the second force are configured to act on the straightness of structural annular flat diaphragm portion 212, the first force and the second force can be partially or completely counteracted, thereby the force which is configured to cause the metal diaphragm 21 to be deformed when the metal diaphragm 21 is vibrated can be partially or completely counteracted. Thereby, the rigidity of the metal diaphragm 21 can be improved, the thickness of the metal diaphragm can be reduced, and the damping characteristics of the metal diaphragm 21 can be increased when the rigidity is constant. Thus, the split distortion of the speaker at high-frequency is reduced to ensure that the metal diaphragm 21 can be normally vibrated to produce sound.

Specifically, as shown in FIG. 5, the cross-section of the metal diaphragm 21 is in a W-shape. As shown by the broken line in FIG. 5, the cross-section of the metal diaphragm 21 herein in a W-shape means that a highest point of the trumpet-shaped diaphragm portion 213 on the left side of the hemispherical diaphragm portion 211, a midpoint of the annular flat diaphragm portion 212 on the left side of the hemispherical diaphragm portion 211, a midpoint of the annular flat diaphragm portion 212 on the right side of the hemispherical diaphragm portion 211, a vertex of the hemispherical diaphragm portion 211, and a highest point of the trumpet-shaped diaphragm portion 213 on the right side of the hemispherical diaphragm portion 211 are in a same cross-section, and the above five points are sequentially connected to form a W-shaped cross-section of the metal diaphragm 21 of the present embodiment.

In the present embodiment, as shown in FIG. 3, the height of the periphery of the trumpet-shaped diaphragm portion 213 away from the hemispherical diaphragm portion 211 is greater than the height of the central portion of the hemispherical diaphragm portion 211. Thus, the hemispherical diaphragm portion 211 can be vibrated in a vibration space formed by the trumpet-shaped diaphragm portion 213, a larger vibration space is provided to the hemispherical diaphragm portion 211, and the vibration frequency range of the metal diaphragm 21 can be effectively expanded.

In the present embodiment, as shown in FIG. 3, the upper and lower surfaces of the annular flat diaphragm portion 212 are regularly flat and both parallel to the horizontal plane. When the voice coil 22 is fixedly connected with the metal diaphragm 21, the voice coil 22 is configured to only need to be bonded to the lower surface of the annular flat diaphragm portion 212, that is, the annular flat diaphragm portion 212 is configured to act as a positioning structure for the voice coil 22, so that the connection between the voice coil 22 and the metal diaphragm 21 can be more convenient, the operation is simpler, and the conformity of the voice coil 22 can be improved due to the flat surface structure of the annular flat diaphragm portion 212. Thus, the connection stability of the voice coil 22 is not affected due to the uneven surface of the annular flat diaphragm portion 212. In addition, when the metal diaphragm 21 is stressed to vibrate, the annular flat diaphragm portion 212 is also stressed to vibrate, and when the annular flat diaphragm portion 212 is vibrated, there is only generated a force in up and down directions, and does not generate a horizontal force due to the annular flat diaphragm portion 212 being designed as a flat structure with double sided flatness. While in the case of the annular flat diaphragm portion 212, such horizontal force is not conducive for vibrating and sound production, which not only affects the normal vibration of the metal diaphragm 21, but may even cause the metal diaphragm 21 to deform.

In this embodiment, as shown in FIG. 3, the angle between the joint of the annular flat diaphragm portion 212 and the hemispherical diaphragm portion 211 is 90° to 180°; the angle between the joint of the annular flat diaphragm portion 212 and the trumpet-shaped diaphragm portion 213 is also 90° to 180°. That is, the hemispherical diaphragm portion 211 is transited to the annular flat diaphragm portion 212 in a gentle obtuse angle form, and the annular flat diaphragm portion 212 is also transited to the trumpet-shaped diaphragm portion 213 in a gentle obtuse angle form, thereby the strength of the connection transition portion can be improved, it is not easily broken by a lateral force, and the overall structural stability of the metal diaphragm 21 can be better ensured.

In this embodiment, the metal diaphragm 21 is preferably made of at least one material selected from the group consisting of the following materials: magnesium, aluminum, beryllium, and titanium, that is, the metal diaphragm 21 is preferably made of magnesium, magnesium alloy, aluminum, aluminum alloy, beryllium, beryllium alloy, titanium, or titanium alloy material. More specifically, the hemispherical diaphragm portion 211, the annular flat diaphragm portion 212, and the trumpet-shaped diaphragm portion 213 are preferably made of pure magnesium metal material. Since the density of the magnesium metal is smaller (the density of the magnesium metal is only 1.74 kilogram (kg)/cubic meter ($m^3$)), a higher sensitivity of the speaker can be ensured by adopting the magnesium metal to manufacture the metal diaphragm 21, and since the magnesium metal can be configured to absorb external vibration, a better damping characteristic of the metal diaphragm 21 can be provided due that the metal diaphragm 21 is made of magnesium metal. In addition, the magnesium metal also has good ductility, and the thickness of the diaphragm can be reduced in the case of a certain rigidity, so that the damping characteristic of the metal diaphragm 21 can be further increased. Therefore, the metal diaphragm 21 of the present embodiment is made of a magnesium metal material, so that the manufactured diaphragm can not only retain the rigidity of the metal, but also has good damping characteristic, the split distortion of the speaker can be weakened, and a better sensitivity of speaker can also be ensured. Alternatively, the hemispherical diaphragm portion 211, the annular flat diaphragm portion 212, and the trumpet-shaped diaphragm portion 213 may all be made of a magnesium alloy material, and the magnesium alloy herein refers to a magnesium alloy material containing more than 96% of a magnesium component, such as AZ13B magnesium alloy, etc. This kind of magnesium alloy has higher strength, better plasticity, and is easy to be made into a thin plate structure, and the requirements for the diaphragm thickness of metal diaphragm 21 can be satisfied greatly, therefore, the rigidity of the diaphragm is increased, the damping characteristic is improved, and the speaker distortion is reduced.

In the present embodiment, a thickness of the metal diaphragm 21 preferably ranges from 6 μm to 50 μm, or from 60 μm to 300 μm, different thicknesses of the metal diaphragms 21 corresponding to different rigidity strengths, and the rigidity thereof is increased synchronously with the increasing of the thickness of the metal diaphragm 21, so when the speaker is designed, the thickness of the metal diaphragm 21 can be selected according to the rigidity required by the speaker, and the thickness herein is not particularly limited. Specifically, it may be 6 μm, 30 μm, 50 μm, 60 μm, 90 μm, 120 μm, 150 μm, 180 μm, 210 μm, 240 μm, 270 μm or 300 μm.

In the present embodiment, the hemispherical diaphragm portion 211, the annular flat diaphragm portion 212, and the trumpet-shaped diaphragm portion 213 are integrally formed. Since the hemispherical diaphragm portion 211, the annular flat diaphragm portion 212, and the trumpet-shaped diaphragm portion 213 are integrally formed, the manufactured metal diaphragm 21 is configured to have good continuity, the vibration process of the metal diaphragm 21 is more stable, and the normal vibration of the metal diaphragm 21 cannot be affected due to the gap between the three thereof. Moreover, since the density of the magnesium metal and the magnesium alloy metal material is small, the texture is brittle, and they are easily broken by a force when being bent, and the above-mentioned annular flat diaphragm portion 212 is configured to play a function of connection and transition between the hemispherical diaphragm portion 211 and the trumpet-shaped diaphragm portion 213. The problem that the hemispherical diaphragm portion 211 being directly folded to form a trumpet-shaped diaphragm portion 213 is solved, and the transition between the hemispherical diaphragm portion 211 and the trumpet-shaped diaphragm portion 213 is more stable and reliable.

In the present embodiment, the hemispherical diaphragm portion 211, the annular flat diaphragm portion 212, and the trumpet-shaped diaphragm portion 213 are preferably integrally formed by stamping. The metal diaphragm 21 of the present embodiment is preferably made of integral and flaky pure magnesium metal material or magnesium metal alloy material that is formed by a stamping machine at one stamping, thus, the metal diaphragm 21 can be made thin enough, the unnecessary deformation of the metal diaphragm 21 cannot be caused due to the stamping process, and the superior performance of the pure magnesium metal and magnesium metal alloy of the metal diaphragm 21 can be ensured.

In this embodiment, as shown in FIGS. 3 to 5, the speaker support 30 includes a frame 32 and a U-shaped cup 31. The frame 32 and the U-shaped cup 31 are in fastening connection with each other to form a mounting cavity, the metal diaphragm 21 covers at the frame 32, and an outer periphery of the flexible connector 23 is connected with an inner periphery of the frame 32.

In this embodiment, as shown in FIG. 2 and FIG. 3, the magnetic circuit system 10 includes a first magnetic assembly 11, a magnet assembly 12, and a second magnetic assembly 13 sequentially stacked in the U-shaped cup 31, and the centers of the U-shaped cup 31, the first magnetic assembly 11, the magnet assembly 12, and the second magnetic assembly 13 are located on the same line; the first magnetic assembly 11 includes a first internal magnetic member 111 and a first external magnetic member 112 disposed around an outer periphery of the first internal magnetic member 111, and the first external magnetic member 112 is spaced apart from the first internal magnetic member 111 to form a first magnetic gap 113; the magnet assembly 12 includes a central magnet 121 and a peripheral magnet 122 disposed around an outer periphery of the central magnet 121, and the peripheral magnet 122 is spaced apart from the central magnet 121 to form a second magnetic gap 123; the second magnetic assembly 13 includes a second internal magnetic member 131 and a second external magnetic member 132 disposed around an outer periphery of the second internal magnetic member 131, and the second external magnetic member 132 is spaced apart from the second internal magnetic member 131 to form a third magnetic gap 133; the first magnetic gap 113, the second magnetic gap 123, and the third magnetic gap 133 are in communication with each other.

Specifically, as shown in FIG. 2 and FIG. 3, a center portion of the U-shaped cup 31 is designed with a positioning cylinder 311, the positioning cylinder 311 and inner sidewalls and an inner bottom wall of the U-shaped cup 31 are enclosed into a receiving groove 312 configured to receive the first magnetic assembly 11, the second magnetic assembly 13, and the magnet assembly 12; and the central magnet 121, the first internal magnetic member 111 and the second internal magnetic member 131 are configured to be annular structures, when the first magnetic assembly 11, the second magnetic assembly 13, and the magnet assembly 12 are received in the receiving groove 312, the central magnet 121, the first internal magnetic member 111 and the second internal magnetic member 131 are respectively sleeved on the positioning cylinder 311 to achieve the purpose of preparing for positioning.

Specifically, as shown in FIG. 2 and FIG. 3, the peripheral magnet 122 includes a plurality of peripheral magnet units 1221 connected end to end, each of the peripheral magnet units 1221 is provided with a first internal magnetic end facing the central magnet 121 and a first external magnetic end facing away from the central magnet 121; the central magnet 121 includes a plurality of central magnet units 1211 connected end to end, each of the central magnet units 1211 are provided with a second external magnetic end facing the peripheral magnet 122 and a second internal magnetic end facing away from the peripheral magnet 122; the magnetic pole of the first internal magnetic end is different from the magnetic pole of the second external magnetic end. The side surfaces of the two adjacent central magnet units 1211 are contracted with each other. Similarly, the side surfaces of the adjacent two peripheral magnet units 1221 are contracted with each other, by such analogy, the plurality of central magnet units 1211 and the plurality of peripheral magnet units 1221 are respectively connected to form the central magnet 121 and the peripheral magnet 122, so that the magnetic pole of an outer ring portion of the central magnet 121 is different from the magnetic pole of an inner ring portion of the peripheral magnet 122, the flux leakage and hysteresis loss can be reduced due to the design of the magnetic circuit system 10, the uniform and symmetric distribution of the magnetic induction line can be further ensured, and the risk of distortion of the speaker can be further reduced to restore the realism of true sound reproduction.

Specifically, the number of above-described peripheral magnet units 1221 is provided with N, the number of central magnet units 1211 is provided with M, and N is preferably configured to equal to M, and the N respective peripheral magnet units 1221 are disposed in one-to-one correspondence with the M respective central magnet units 1211. In this way, an end surface of the first internal magnetic end of the peripheral magnet unit 1221 can be opposite to an end surface of the second external magnetic end of the center magnet unit 1211 and parallel to each other, so that the uniformity of the magnetic induction line in the second magnetic gap 123 is not affected due to the existence of a connection gap, so that the distribution of the magnetic induction lines in the second magnetic gap 123 is more uniform.

More specifically, as shown in FIG. 2 and FIG. 3, the shape and size of the first internal magnetic member 111 and the second internal magnetic member 131 are configured to be substantially equal to the shape and size of the central magnet 121, and the shape and size of the first external magnetic member 112 and the second external magnetic member 132 are configured to be substantially equal to the shape and size of the peripheral magnet 122; and an upper surface of the first internal magnetic member 111 is attached to a lower surface of the central magnet 121, an upper surface of the first external magnetic member 112 is attached to a lower surface of the peripheral magnet 122, a lower surface of the second internal magnetic member 131 is attached to an upper surface of the central magnet 121, and a lower surface of the second external magnetic member 132 is attached to an upper surface of the peripheral magnet 122; and a side of the center magnet 121 is vertically aligned with sides of the first internal magnetic member 111 and the second internal magnetic member 131, a side of the peripheral magnet 122 is vertically aligned with sides of the first external magnetic member 112 and the second external magnetic member 132, so that the communication area among the first magnetic gap 113, the second magnetic gap 123, and the third magnetic gap 133 can be largest, and a largest space is provided for the forming of the magnetic induction line to improve the efficiency of sound production of the speaker.

In this embodiment, as shown in FIG. 2 and FIG. 3, the vibration system 20 further includes a voice coil 22, and a first end of the voice coil 22 is fixedly connected to the metal diaphragm 21, that is, the voice coil 22 is in bonding fixed to a lower surface of the annular flat diaphragm portion 212 of the metal diaphragm 21, a second end of the voice coil 22 is configured to sequentially pass through the third magnetic gap 133 and the second magnetic gap 123 and being in suspension disposed in the first magnetic gap 113. The voice coil 22 is configured to act as a power source of the speaker of the present embodiment, and one end thereof is fixedly connected to the lower surface of the annular diaphragm portion 212 of the metal diaphragm 21, and the other end thereof is configured to sequentially pass through the third magnetic gap 133 and the second magnetic gap 123 and is suspended in the first magnetic gap 113, when an external audio current signal is transmitted to the voice coil 22, the magnetic induction lines in the first magnetic gap 113, the second magnetic gap 123, and the third magnetic gap 133 are cut by the voice coil 22 to generated mechanical vibration to cause the speaker to vibrate and to produce sound.

In this embodiment, as shown in FIG. 2, the speaker further includes a circuit board 50, the circuit board 50 is fixedly connected to the frame 32, and the circuit board 50 is electrically connected with the voice coil 22. The conduction between internal and external circuits of the speaker of the embodiment is realized via the circuit board 50, and the external audio signal current of the speaker is transmitted to the inside of the speaker via the circuit board 50.

In this embodiment, as shown in FIG. 2 and FIG. 3, the speaker further includes a damping enhancement system 40, the damping enhancement system 40 includes a first damping member 41 configured to be covered on an outer bottom of the frame 32 and a second damping member 42 configured to be covered on an outer bottom of the U-shaped cup 31. The first damping member 41 and second damping member 42 are respectively arranged at the outer bottom of the frame 32 and the outer bottom of the U-shaped cup 31. To enhance the damping characteristic of the metal diaphragm 21, the vibration reaction force of the metal diaphragm 21 is reduced and the vibration effect of the metal diaphragm 21 is increased, and the use of the metal diaphragm resulting sound quality deterioration is avoided, and the sounding effect of the speaker is improved. Specifically, the first damping member 41 and the second damping member 42 of the present embodiment are both made of materials having good damping properties, such as damping paper, damping rubber, damping plastic and the like, which are commonly used in the market, and the damping paper with a cheaper price and excellent characteristics is preferable.

The above are only the preferred embodiments of the present application, and are not intended to limit the present application. Any modifications, equivalent substitutions or improvements made within the spirit and principles of the present application are included in the scope of the present application.

What is claimed is:

1. A speaker, comprising:

a magnetic circuit system;

a vibration system; and a speaker support, wherein the speaker support is provided with a mounting cavity, wherein both the magnetic circuit system and the vibration system are mounted in the mounting cavity, wherein the vibration system comprises a metal diaphragm and a flexible connector, wherein the metal diaphragm is placed in the mounting cavity, wherein an inner periphery of the flexible connector is bonded to an outer periphery of the metal diaphragm, and an outer periphery of the flexible connector is bonded to an inner periphery of the speaker support, wherein the metal diaphragm comprises a hemispherical diaphragm portion provided with a central convex, wherein a periphery of the hemispherical diaphragm portion is extended in a horizontal direction to form an annular flat diaphragm portion, wherein a periphery of the annular flat diaphragm portion is folded toward the convex direction of the hemispherical diaphragm portion and is extended away from the hemispherical diaphragm portion to form a trumpet-shaped diaphragm portion, and wherein the annular flat diaphragm portion is configured to partially or completely counteract forces generated in the horizontal direction by the hemispherical diaphragm portion and the trumpet-shaped diaphragm portion.

2. The speaker of claim 1, wherein the flexible connector is made of a non-metallic material.

3. The speaker of claim 1, wherein the flexible connector is made of at least one material selected from the group consisting of a polyethylene terephthalate (PET), a polyethylene naphthalate two formic acid glycol ester (PET), a polyetheretherketone (PEEK), a polyurethane (PU), a polyarylate (PAR), a polyarylate (PAR), a polyetherimide (PEI), a silica gel, a silk, and a cloth.

4. The speaker of claim 1, wherein a middle portion of the flexible connector is arched in a direction away from the speaker support to form an arcuate structure, and wherein the arcuate structure is provided with a hanging edge at each periphery thereof.

5. The speaker of claim 1, wherein an outer periphery of the trumpet-shaped diaphragm portion is in sealing connection with an inner circumference of the flexible connector.

6. The speaker of claim 5, wherein a height of an outer periphery of the trumpet-shaped diaphragm portion is greater than a height of a central portion of the hemispherical diaphragm portion.

7. The speaker of claim 1, wherein the metal diaphragm is made of magnesium.

8. The speaker of claim 1, wherein a thickness of the metal diaphragm ranges from 6 micrometers (μm) to 50 μm.

9. The speaker of claim 1, wherein the speaker support comprises a frame and a U-shaped cup, wherein the frame and the U- shaped cup are in fastening connection with each other to form the mounting cavity, wherein the metal diaphragm covers the frame, and wherein an outer periphery of the flexible connector is connected with an inner periphery of the frame.

10. The speaker of claim 9, wherein the magnetic circuit system comprises a first magnetic assembly, a magnet assembly, and a second magnetic assembly sequentially stacked in the U-shaped cup, wherein the centers of the U-shaped cup, the first magnetic assembly, the magnet assembly, and the second magnetic assembly are located on the same line wherein the first magnetic assembly comprises a first internal magnetic member and a first external magnetic member disposed around an outer periphery of the first internal magnetic member, wherein the first external magnetic member is spaced apart from the first internal magnetic member to form a first magnetic gap, wherein the magnet assembly comprises a central magnet and a peripheral magnet disposed around an outer periphery of the central magnet, wherein the peripheral magnet is spaced apart from the central magnet to form a second magnetic gap, wherein the second magnetic assembly comprises a second internal magnetic member and a second external magnetic member disposed around an outer periphery of the second internal magnetic member, wherein the second external magnetic member is spaced apart from the second internal magnetic member to form a third magnetic gap, and wherein the first magnetic gap, the second magnetic gap, and the third magnetic gap are in communication with each other.

11. The speaker of claim 10, wherein the vibration system further comprises a voice coil, wherein a first end of the voice coil is fixedly connected to the metal diaphragm, and wherein a second end of the voice coil is configured to sequentially pass through the third magnetic gap and the second magnetic gap and is suspended in the first magnetic gap.

12. The speaker of claim 11, wherein the speaker further comprises a circuit board, wherein the circuit board is fixedly connected to the frame, and wherein the circuit board is electrically connected to the voice coil.

13. The speaker of claim 9, wherein the speaker further comprises a damping enhancement system, and wherein the damping enhancement system comprises a first damping member configured to sealingly cover an outer bottom of the frame and a second damping member configured to sealingly cover an outer bottom of the U-shaped cup.

14. The speaker of claim 10, wherein the speaker further comprises a damping enhancement system, and wherein the damping enhancement system comprises a first damping member configured to sealingly cover an outer bottom of the frame and a second damping member configured to sealingly cover an outer bottom of the U-shaped cup.

15. The speaker of claim 11, wherein the speaker further comprises a damping enhancement system, and wherein the damping enhancement system comprises a first damping member configured to sealingly cover an outer bottom of the frame and a second damping member configured to sealingly cover an outer bottom of the U-shaped cup.

16. The speaker of claim 12, wherein the speaker further comprises a damping enhancement system, and wherein the damping enhancement system comprises a first damping member configured to sealingly cover an outer bottom of the frame and a second damping member configured to sealingly cover an outer bottom of the U-shaped cup.

17. The speaker of claim 1, wherein the metal diaphragm is made of aluminum.

18. The speaker of claim 1, wherein the metal diaphragm is made of beryllium.

19. The speaker of claim 1, wherein the metal diaphragm is made of titanium.

20. The speaker of claim 1, wherein a thickness of the metal diaphragm ranges from 60 micrometers (μm) to 300 μm.

* * * * *